US005524102A

United States Patent [19]

Liao et al.

[11] Patent Number: 5,524,102

[45] Date of Patent: Jun. 4, 1996

[54] GLOBAL TIMEPIECE

[75] Inventors: Yi-Yen Liao, Hsinchu; Jaw-Horng Tzeng, Feng Shan; Jung-Che Hsieh, Taipei; June-Sheng Weng, Hsinchu, all of Taiwan

[73] Assignee: Industrial Technology Research Institute, Hsinchu Hsien, Taiwan

[21] Appl. No.: 404,075

[22] Filed: Mar. 14, 1995

[51] Int. Cl.[6] ..... G04B 19/22

[52] U.S. Cl. ..... 368/21; 368/27

[58] Field of Search ..... 368/21–28

[56] References Cited

U.S. PATENT DOCUMENTS

| | | | |
|---|---|---|---|
| 651,832 | 6/1900 | Davis | 368/27 |
| 701,853 | 6/1902 | Davis | 368/27 |
| 2,641,898 | 6/1953 | Galley | 368/27 |
| 3,599,421 | 8/1971 | Waller | 368/21 |
| 4,945,521 | 7/1990 | Klaus | 368/21 |

FOREIGN PATENT DOCUMENTS

| | | | |
|---|---|---|---|
| 282144 | 7/1952 | Switzerland | 368/21 |
| 339128 | 7/1959 | Switzerland | 368/21 |

*Primary Examiner*—Bernard Roskoski
*Attorney, Agent, or Firm*—W. Wayne Liauh

[57] ABSTRACT

A structural improvement for the global timepiece principally makes use of an hour wheel which engages and drives a post hour wheel and thereto engages and drives a city wheel through a post hour pinion which is on the same shaft as the post hour wheel, and sequentially lock-to-fit to rotate the city wheel and the city dial through the lock jumper, thereby makes the face become an outer ring which is a stationary time ring, a center ring which is a otationally adjustable city dial and an inner ring which is a dial indicating the local time; in this way and through the simple judgement, one is able to read simultaneously, from the same timepiece's face, the time of each time zone's city all over the world, also as far as time adjustment as concern, one can use the hour wheel or city dial or both to adjust the time inquired. Besides, the face design of the present invention can read clearly and easily the date everywhere through the indication of the international dateline. This is an original work with practical and progressive features.

11 Claims, 5 Drawing Sheets

GLOBAL TIMEPIECE

FIELD OF THE INVENTION

The present invention particularly indicates a structural improvement for the global timepiece which can provide an easy way to read, from the same face, the time and date everywhere all over the world and can conveniently adjust the time needed to indicate.

BACKGROUND OF THE INVENTION

Owning to the greatly elevated living standard of our country people, the chances of touring and business negotiating abroad are getting more frequent and fervnet. To understand and master the local time becomes more and more important for those people traveling around the world. Under this kind of demand, the common timepiece will not be able to provide this kind of information. As far as the function as concern, the people who are frequently traveling abroad need to have a timepiece which can provide, at any moment, the local time all over the world so that they can control the time effect and strive for the business opportunities. The traditional way of telling time in the world's major cities is just like the common travel agencies or hotels where several clocks are hung on the wall behind the reception counter, and each clock indicates the local time of a certain major city. As the whole world is divided into twenty four time zones, one can hang only several clocks to indicate several major cities's time since the space is limited. This certainly can not satisfy people from all over the world. Gradually, various kinds of global timepiece have been developed to improve this inconvenient situation which can show the local time all over the world through the reading of a single timepiece to substitute the traditional way of telling time by several wall-clock, thereby, greatly elevate the funtion of the timepieces. Observing the current global timepieces, although they have possessed the function of providing the global time, there are still shortcomings in many respects and far from the ideal. Followings are explanations with respect to their types and functions:

1. Please refer to FIG. 1, the case of this type of global timepiece has a fixed scale, the center ring is a rotatable city dial, the inner ring is a general time indication. The way of showing time is to rotate the city dial untill the city position inquired match the scale on the case. At this moment, the hour hand in the inner ring follows the rotation of the city dial to show the city time inquired. There is a big shortcoming of this type of showing time, that is, it can show, on the face, only the time of a single time zone and is unable to show different time in different time zones simultaneously which is not appropriate to be used in public places. Also, it shows insufficient in function when it comes to comparing local time for different time zones.
2. Please refer to FIG. 2, the face of this type of timepiece is a kind of mother-and-son face, wherein the large time dial is for local time, and the small time scale and hands are for indicating the city time inquired which can be rotated in accordance with the city dial. The shortcoming of this way of showing time is the same as the aforesaid in explanation 1., what is more, this type needs more material for parts is manufacturing which not only can not upgrade the original function but also increases the manufacturing cost. In the practical point of view, it shows rather inadequate.

3. Please refer to FIG. 3, in this type of timepiece's face, the outer ring is a fixed city dial, the center ring is a rotatable time zone ring, and the inner ring, however, is a fixed local time dial. The way of showing time is that after searching for the inquired city zone directly, match the time zone scale required, then this is the time for that city. Although this type of showing time can show the time in different time zones on the same timepiece's face simultaneously, which modifies the aforesaid shortcomings in explanation 1. and 2., it needs to accompany the clockwise rotation of the inner ring's hour hand, insomuch, the scale of the time zone must be arranged in counterclockwise order, thereby, it is very uneasy to read time according to the customary direction of reading timepiece, especially it is much more tedious on the date reading since one needs to deduce in a reverse way. As far as the customary way of reading time as concern, it appears complicated and not easy to read and thereby, not practical.

Inasmuch, the inventor then, with his years of research experience, constantly modifies the design, at long last, creates a kind of global timepiece, which can be read quickly and also easy to be adjusted, to improve the aforesaid shortcomings. It can make the global timepiece even more practical and ideal and proceed to upgrade the benefit of utilization which is the aim of the design of the present invention.

SUMMARY OF THE INVENTION

The primary objective of the present invention is to provide a structural improvement for the global timepiece. On the face design, the outer ring is a stationary time zone ring, with twenty four time zones, which is arranged in clockwise order; the center ring is a city dial which can accompany the hour hand to rotate; and the way of transmission of the second hand, minute hand, hour hand and alarm bell is the same as the gear trains rotation which is driven by the change of magnetic field of the motor's , induction coil. The present invention principally makes use of the hour wheel to engage and drive the post hour wheel to rotate and then to engage and drive the city wheel to rotate, through a post hour pinion which is on the same shaft as the post hour wheel. There is no limitation or rule for the gear ratio so long as the gear ratio for hour wheel and city wheel is 2:1, since the design principle is that the hour hand rotates a cycle being twelve hours and as the globe is divided into twenty four time zones, thereby, the hour hand rotates two cycles being a day while the globe spins a cycle to pass through twenty four time zones, hence the revolution ratio of the time wheel and city wheel being 2:1. Also a lock jumper is provided to lock-to-fit the city wheel and while the city wheel rotates, through the lock jumper, the city wheel drives the city dial to rotate. Besides, the city dial alone is sometimes provided also with a wind knob which enables it to rotate independently. What is more, the outer ring is provided also with a lock pin on the case surface to match with the city dial, to control the city dial's rotation. Thereby, one can adjust the hour wheel or city dial or both to get the appropriate local time, and when it comes to judge reading the time and date inquired, he can quickly read to obtain the time information in each time zone all over the world by the customary correct direction and looking up the time zone scale on the city dial.

BRIEF DESCRIPTION OF THE DRAWINGS

To facilitate your honor examiners to fully understand the present invention, a practical embodiment with accompanied drawings in conjunction with detailed explanation is as follows.

DESCRIPTION OF THE COMPONENT NUMBER

| | |
|---|---|
| 10 Time zone ring | 11 City dial |
| 12 Dial | 13 Hour wheel |
| 14 Post hour wheel | 15 Wheel shaft |
| 16 Post hour pinion | 17 City wheel |
| 18 Lock jumper | 19 Wind knob |
| 20 Lock pin | |

DETAILED DESCRIPTION OF THE INVENTION

Figure 1:
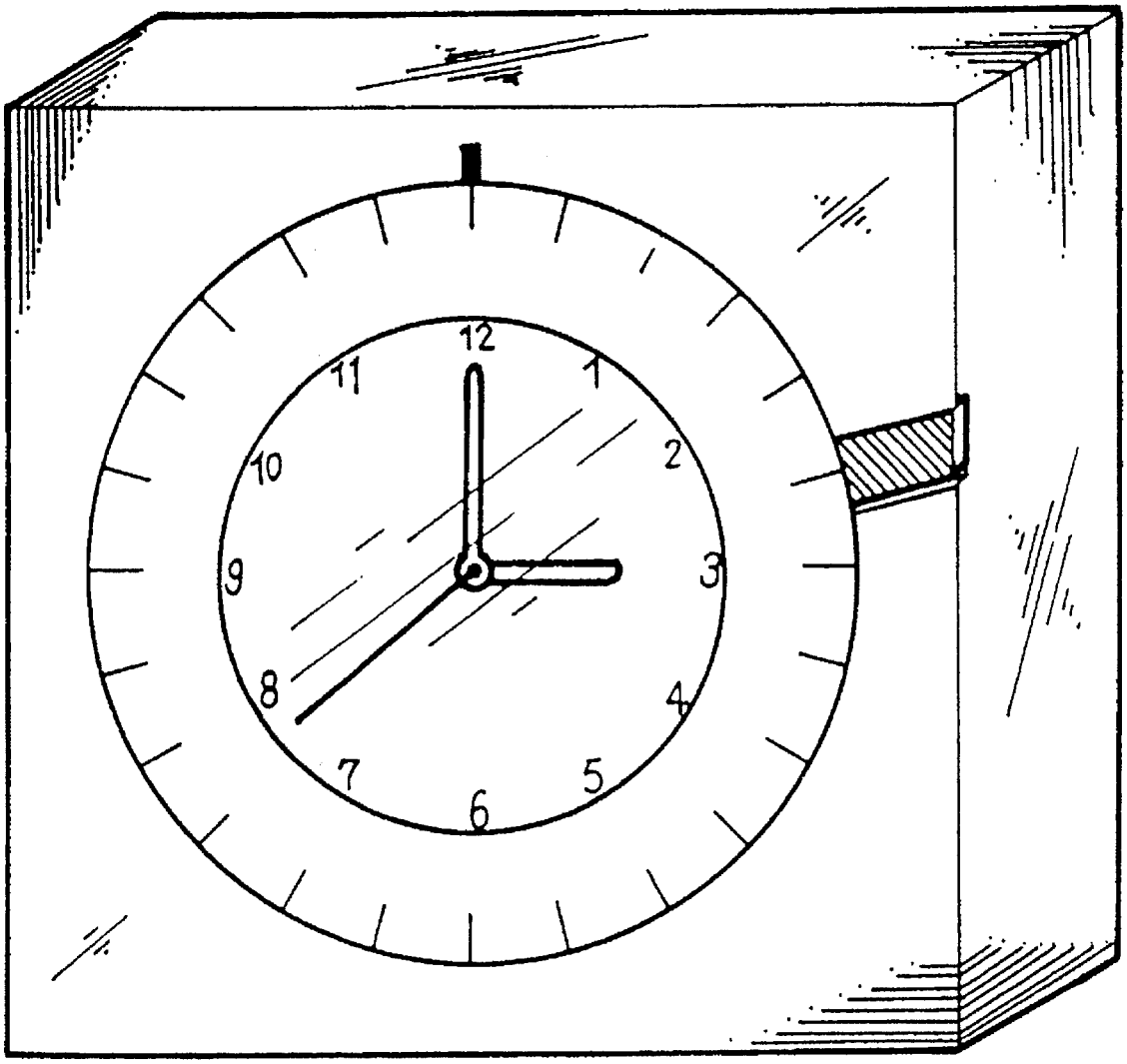
Fig. 1 PRIOR ART
FIG. 1 is the schematic diagram of the prior art's global timepiece(I)
Figure 2:
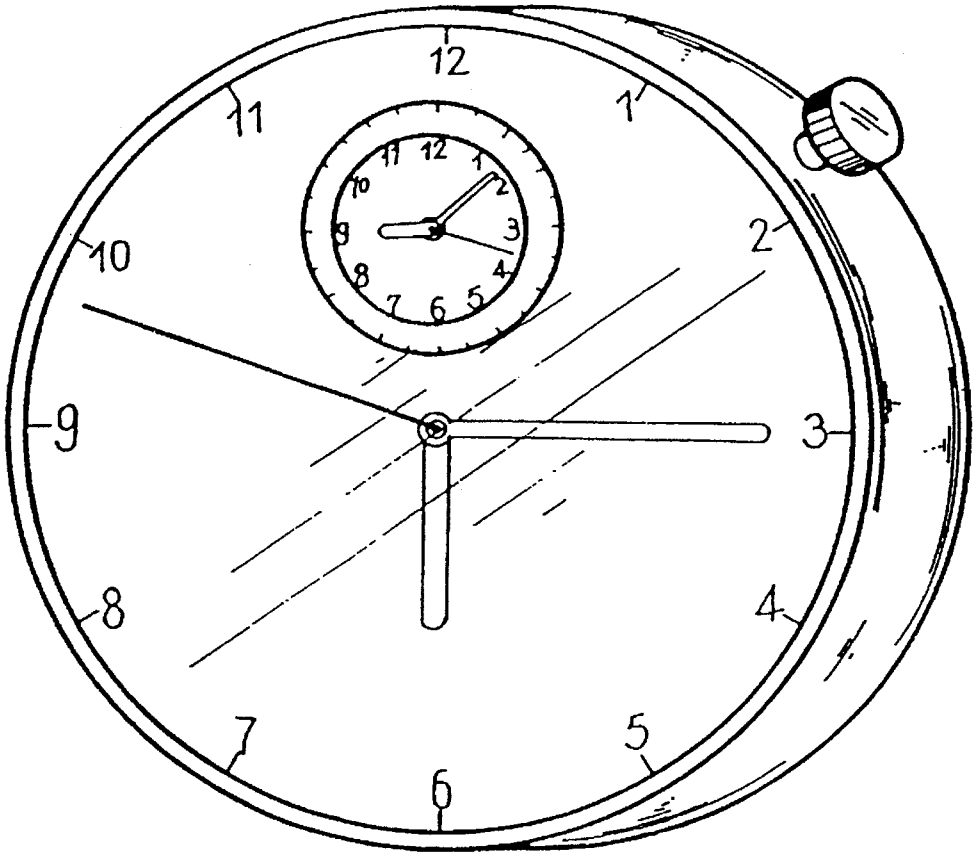
Fig. 2 PRIOR ART
FIG. 2 is the schematic diagram of the prior art's global timepiece( )
Figure 3:
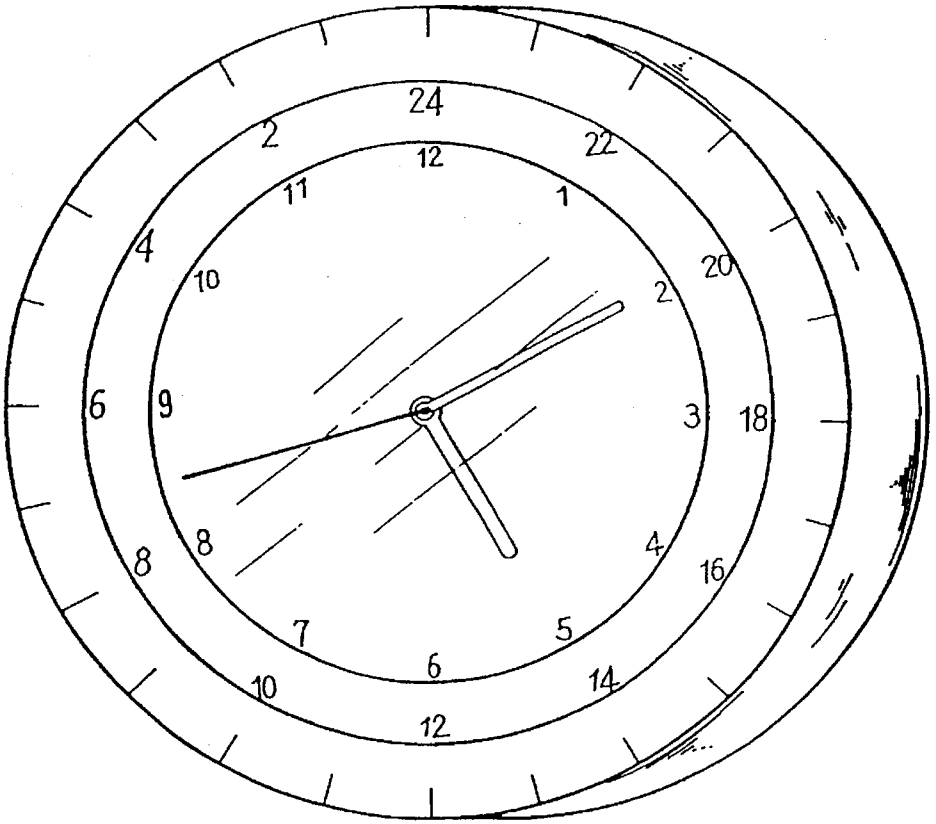
Fig. 3 PRIOR ART
FIG. 3 is the schematic diagram of the prior art's global timepiece( )
Figure 4:
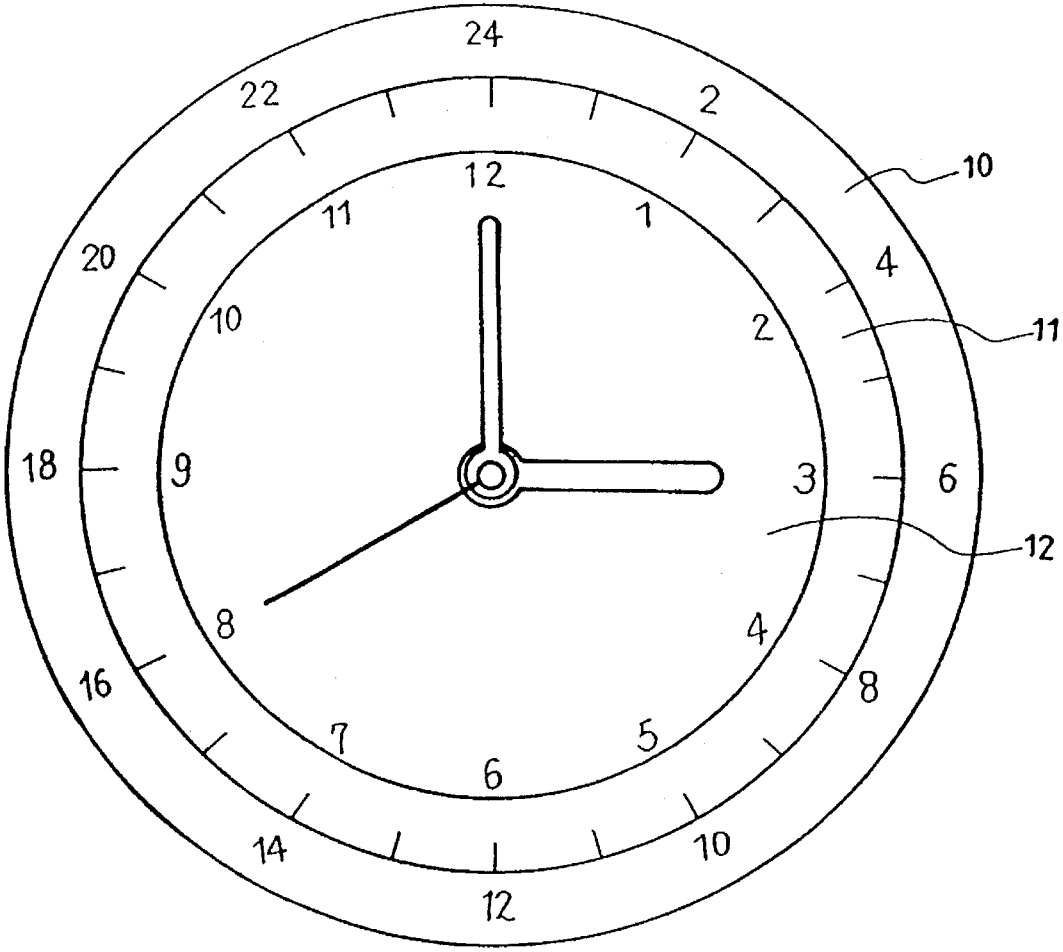
FIG. 4 is the plan view of the present invention.

Referring to FIG. 4, on the timepiece's face, the outer ring is a stationary time zone ring 10 with twenty four time zone divisions, the center ring is the city dial 11 which can rotate together with the city wheel and is annotated on, with names of the major cities in each time zone, and the inner ring is a fixed dial 12 indicating local time.

Figure 5:
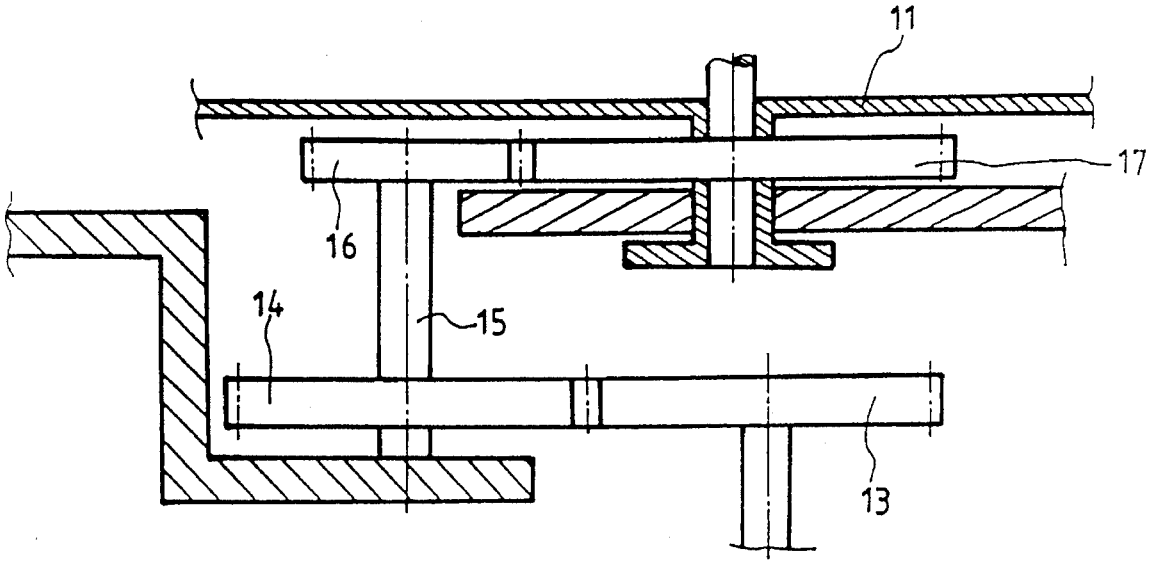
FIG. 5 is the schematic transmission diagram of the present invention.

Referring to FIG. 5 the way of present invention's transmission on hour hand, minute hand and second hand is the same as that of the common timepiece, i.e. to make use of the alternating changes of the magnetic field of the motor's coil to drive the gear train, which will not be reiterated here. As far as the main parts of the hour wheel and city wheel is concerned, the present invention makes use of the hour wheel 13 to engage and drive to rotate the post hour wheel 14 on which the shaft 15 having its other end keyed in a post hour pinion 16, which in sequence, engages and drives the city wheel 17. The gear ratio of the gear train has no compulsory rule of limitation except that the one between hour wheel and city wheel be 2:1,i.e. as hour wheel 13 rotates two revolutions,the city wheel 17 rotates one revolution. This is to make use of the fact that the globe is divided into twenty four time zones and while the earth spins a revolution, which passes through twenty four time zones, it takes twenty four hours exactly.

Figure 6:
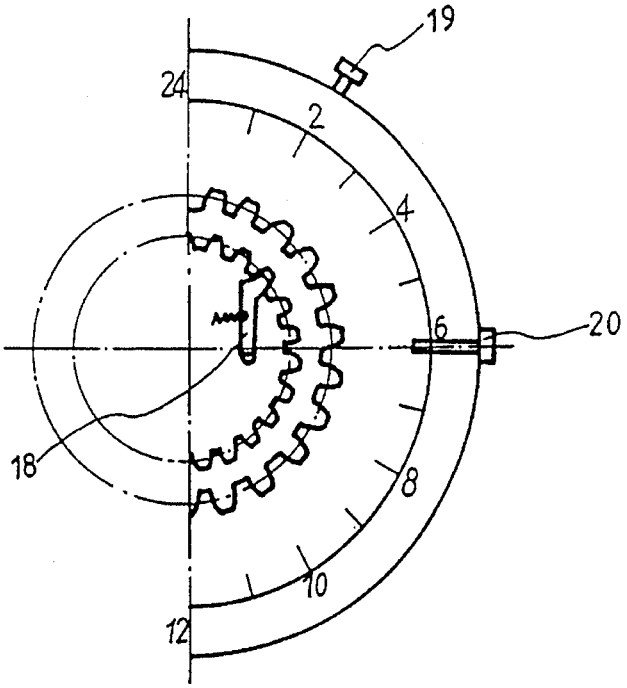
FIG. 6 is the schematic driving diagram of the city wheel and city dial of the present invention.

Referring to FIG. 6, the city dial 11 makes use of the lock jumper 18 to lock-to-fit the inner teeth of the city wheel's gear. The inner gear has twenty four teeth, therefore as the city wheel 17 turns a revolution its inner wheel also turns a revolution of twenty four teeth and, in sequence, the city dial 11 turns also a revolution of twenty four time zones. Besides, the city dial 11 provides with an independent wind knob which can turn the city dial to rotate. Also, the case provides with a lock pin 20 which can lock-to-fix the city dial 11 and time zone ring 10 so that both of them can not rotate. By means of design as above, the present invention can quickly adjust to find out the user's inquired time.

Referring again to FIG. 4, if the local time in Hong Kong for the time being is three o'clock A.M., one can read exactly from the time zone ring 10 to see Hong Kong locate in three o'clock time zone, if the local time one inquires is Tokyo, he can read it on the city dial 11 to locate the Tokyo position and find out the corresponding time zone is four o'clock on the time zone ring, hence the Tokyo time is four o'clock A.M.

What is more, Wellington is the internatoinal dateline, its location is in the seven o'clock time zone. This makes the time zone from 0 through 7 o'clock belong to the same day and the rest being a day before, thereby, the present invention is very ease to judge reading the date of each city. Take the city of London as another example. From the same FIG. 4 one can judge reading that the time is 19 o'clock a day before. In order to accompany the time adjustment, the present invention can use the ways as follows:

1. To adjust by the hour wheel:

As the city dial is locked by the lock pin, it makes the lock jumper, which is in between the city dial and city wheel, come off and leaves only the hour wheel rotating. This way is applicable, after one arrives in a foreign land, to have the local time dial directly adjusted to the time where one currently stays. This can provide one the local time for later information.

2. To adjust by the city dial:

After making the lock pin separate from the city dial, one can turn the wind knob which will make the lock jumper to loose the city wheel as well as the transmission train, which, in sequence, makes the rotation of city dial only but not the hour wheel since it is in the reverse direction of the power source. This is applicable to adjust when the time zone is incorrect.

3. To adjust both the city dial and the hour wheel:

After making the lock pin separate from the city dial, use the hour wheel to drive the transmission train which makes the city dial to rotate at the same time. This is applicable to the overall adjustment when the power soure is insufficient in power and needed to replace new batteries.

To summarize the foregoing statements, the present invention can quickly interpret reading the time and date of each of the major cities around the world. It is easy to make all kinds of adjustment and coordination. It profoundly possesses the practicality and progressiveness to provide the industry with the value of utilization and it is not found in any similar products, nor in any public publications, thereby is in accordane with the patentability which makes the inventor files this application.

What is claimed is:

1. A global timepiece comprising:

a timepiece face;

a time zone ring, which is a stationary outer ring of said timepiece face, said time zone ring having a scale with 24 divisions of time zones;

a rotatable city dial, which forms a center ring of said face, said city dial having a scale with 24 time zones of major cities;

a city wheel having a plurality of inner teeth;

a lock jumper which locks said inner teeth of said city wheel with said city dial so as to cause said city dial to rotate therewith;

an independent wind knob which allows said city dial to rotate independently;

a dial, which is a fixed inner ring of the timepiece face, said dial having an hour hand, a minute hand and a second hand to indicate time; and an hour wheel, which is a gear, for engaging and driving said hour hand to rotate, said hour wheel, together with a post hour wheel and a post hour pinion, engage and drive said city wheel to rotate;

whereby during an operation of said global timepiece, said post hour wheel, is caused to rotate via an engagement with said hour wheel; said post hour pinion, which is provided on a same shaft as said post hour wheel and is engaged with said city wheel causes said city wheel also to rotate; said city wheel is locked with said city dial by means of said lock jumper to thereby cause said city dial to rotate.

2. A global timepiece as claimed in claim 1, wherein said hour wheel and said city wheel has a gear ratio of 2:1.

3. A global timepiece as claimed in claim 1, wherein city dial is locked with the inner teeth of said city wheel via a lock jumper in a lock-to-fit manner.

4. A global timepiece as claimed in claim 1, wherein said hour wheel is designed to make two complete rotations for every complete rotation of said city wheel.

5. A global timepiece as claimed in claim 1, which further comprising a lock pin to be placed between said stationary outer ring and said rotatable city dial so as to prevent said city dial to rotate when necessary and thereby allowing said hour wheel to adjust the time indicated by said dial, which is a fixed inner ring without affecting said city dial.

6. A global timepiece as claimed in claim 1, wherein said wind knob is provided at the city dial, and, by turning said wind knob, said lock jumper becomes loosened from the city dial to thereby allow said city dial to rotate independently.

7. A global timepiece as claimed in claim 1, wherein said hour wheel and said city dial are engaged in such a manner such that a turning of said hour wheel can, at the same time, adjust a time indicated by said dial and a location of said city dial.

8. A global timepiece comprising:

a timepiece face;

a time zone ring, which is a stationary ring on said timepiece face, said time zone ring having a scale with 24 divisions of time zones;

a rotatable city dial, which is another ring on said face, said city dial having a scale with 24 time zones of major cities;

a city wheel having a plurality of inner teeth;

a locking means which locks said inner teeth of said city wheel with said city dial so as to cause said city dial to rotate therewith;

an independent wind knob which allows said city dial to rotate independently;

a dial, which is a fixed ring on the timepiece face, said dial having an hour hand, a minute hand and a second hand to indicate time; and an hour wheel, which is a gear, for engaging and driving said hour hand to rotate, said hour wheel, together with a post hour wheel and a post hour pinion, engage and drive said city wheel to rotate;

whereby during an operation of said global timepiece, said post, hour wheel, is caused to rotate via an engagement with said hour wheel; said post hour pinion, which is provided on a same shaft as said post hour wheel and is engaged with said city wheel, causes said city wheel also to rotate; said city wheel is locked with said city dial by means of said locking means to thereby cause said city dial to rotate.

9. A global timepiece as claimed in claim 8, wherein said lock means comprises a friction wheel for locking said city dial with said city wheel in a lock-to-fit manner.

10. A global timepiece as claimed in claim 8, wherein said lock means comprises a lock jumper for locking said city dial with said city wheel in a lock-to-fit manner.

11. A global timepiece as claimed in claim 8, wherein said lock means comprises a friction wheel for locking said city dial with said city wheel in a lock-to-fit manner.

* * * * *